United States Patent [19]

Laterza

[11] Patent Number: 4,873,790

[45] Date of Patent: Oct. 17, 1989

[54] PLANT SPINNER

[76] Inventor: Joseph Laterza, 1456 Middle Country Rd., Centereach, N.Y. 11720

[21] Appl. No.: 237,279

[22] Filed: Aug. 26, 1988

[51] Int. Cl.[4] ..... A01G 9/02

[52] U.S. Cl. ..... 47/67; 136/206; 136/291

[58] Field of Search ..... 47/67; 136/206; 323/906

[56] References Cited

U.S. PATENT DOCUMENTS 4,574,521 3/1986 Landy ..... 47/67

FOREIGN PATENT DOCUMENTS 2504605 10/1982 France ..... 136/206
96776 5/1986 Japan ..... 136/291
8898 7/1885 United Kingdom ..... 47/67

OTHER PUBLICATIONS

Solarex Corporation, Information Sheet, 9/1978.

*Primary Examiner*—Robert A. Hafer
*Assistant Examiner*—Lynda M. Cofsky
*Attorney, Agent, or Firm*—Richard L. Miller

[57] ABSTRACT

This plant spinner is designed to rotate potted plants, so as to evenly expose them to the rays of the sun. Primarily, it consists of a simulated flower that is adhered to a window pane, and the petals of the flower are provided with a multiple number of solar cells that convert the rays of the sun to electric current that drives a motor that slowly rotates a potted plant that is suspended from the plant spinner. Each solar cell in the flower is capable of powering a separate plant spinner, and the rotation of such potted plants provides for better growth because of them being evenly exposed to the rays of the sun.

7 Claims, 1 Drawing Sheet

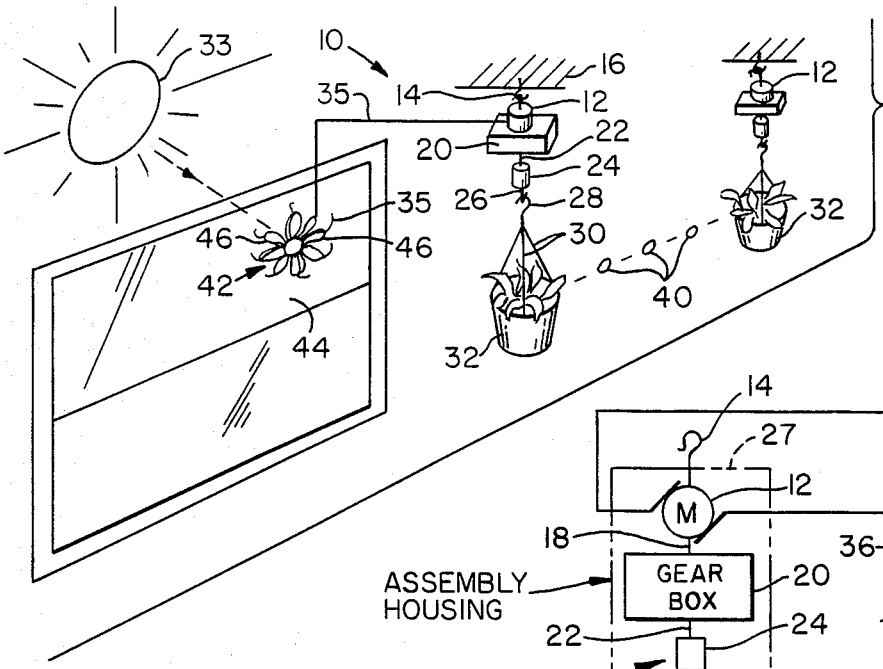
FIG. 1
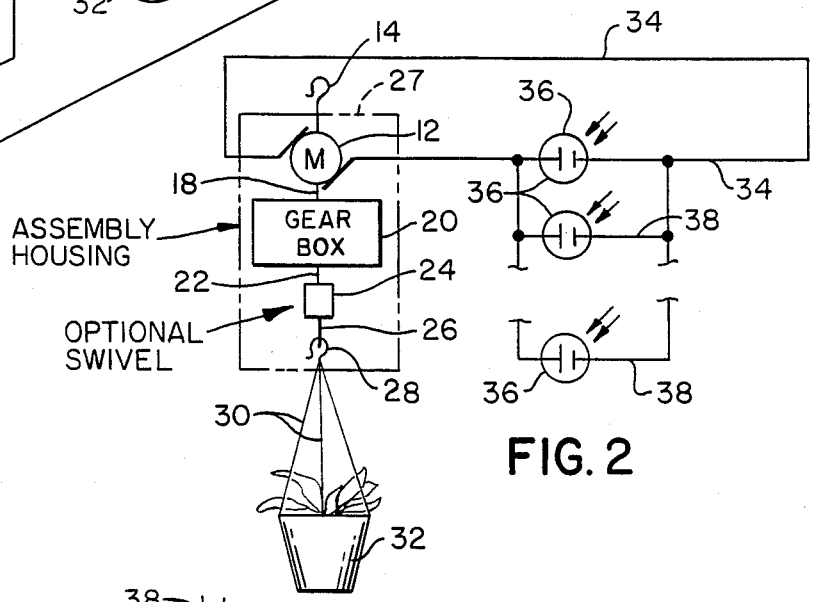
FIG. 2
FIG. 3
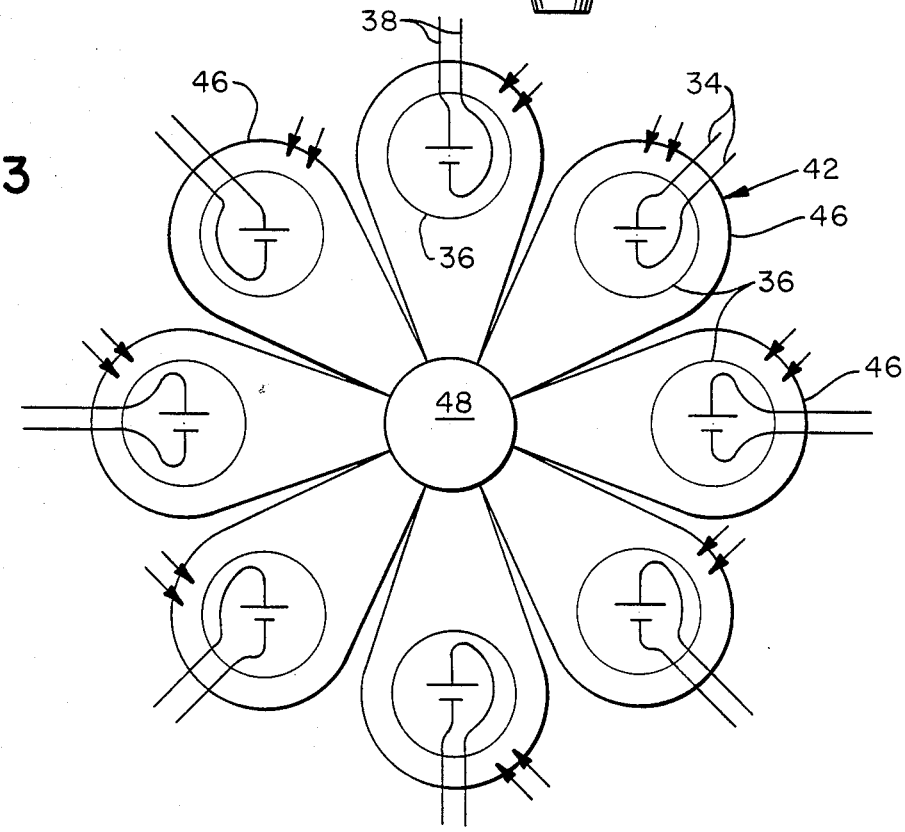

PLANT SPINNER

BACKGROUND OF THE INVENTION

The instant invention relates generally to accessory devices for plants, and more particularly, to a plant spinner.

Numerous electrical spinning devices have been provided in the prior art that are adapted to rotate articles. For example, U.S. Pat. No. 4,574,521 of Landy, U.S. Pat. No. 4,373,695 of Faris, and U.S. Pat. No. 4,238,002 of Hexmer, all are illustrative of such prior art. While these units may be suitable for the particular purpose to which they address, they would not be as suitable for the purpose of the present invention as hereafter described.

SUMMARY OF THE INVENTION

A primary object of the present invention is to provide a plant spinner that will overcome the shortcomings of the prior art devices.

Another object is to provide a plant spinner that will be unique in design, in that it will rotate a hanging plant to expose it evenly with the sun.

An additional object is to provide a plant spinner that will be so designed, as to employ solar cells for its operation.

A further object is to provide a plant spinner that is simple and easy to use.

A still further object is to provide a plant spinner that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view illustrating the instant invention in use;

FIG. 2 is a schematic diagram of the instant invention; and

FIG. 3 is an enlarged diagrammatic view of a solar cell unit of the instant invention per se.

DETAILED DESCRIPTION OF THE PREFERRED EMBODIMENTS

Turning now descriptively to the drawings, in which like reference characters denote like elements throughout the several views, a plant spinner 10 is shown to include an electric motor 12 having a hook 14 attached thereto, that engages with a similar hook fastened in a ceiling 16. The shaft 18 of the motor 12 is coupled to a reduction gear box 20, the output shaft 22 being secured to one side of an optional swivel 24 having an attached hook 26 that provides for engagement with a hook 28 attached to cords 30 of a potted plant 32 that is slowly rotated by spinner 10 for exposing the potted plant 32 evenly to the sun 33.

The motor 12, the gear box 20, and the optional swivel 24 are housed in an assembly housing 27, and a pair of wires 34 connecting with motor 12, are enclosed in a cable 35 and are wired in series with a solar cell 36 that receives solar energy from the sun 33 to power the motor 12.

The optional swivel 24 is to prevent damage in situation where the plant 32 is accidentally mechanically prevented from rotating where otherwise the motor 12 might be stalled or the cords 30 might be twisted and broken.

Other potted plants 32 may also be suspended and rotated while being powered by other solar cells 36 that are wired in parallel to wires 34 by wires 38, and may be positioned as illustrated in FIG. 1, by the positions 40.

Referring now particularly to FIG. 3, a simulated flower 42 is provided with an adhesive or suction cup backing at center portion 48 for adhering to a window pane 44. A solar cell 36 is fixedly secured in the outer portions of each of the petals 46 that are radially spaced and fixedly secured to a center portion 48 of the simulated flower 42. Alternatively adhesive backed mating hook and loop pile fastener material may be used as a securement mechanism for holding the device to an appropriate surface.

In operation, a solar cell 36 produces current that by the cable 35 travels to the motor 12, and the attached gear box slowly rotates the potted plant 32 enabling it to evenly receive the rays of the sun 33 for even and full growth.

It is to be noted that the typical petal solar cell device illustrated has eight cells, one on each petal which can be either separately connected to separate plant spinners, or alternatively can be connected to each other in parallel or series connection to rotate a larger plant spinner, depending upon power match required. One might also, for example, decide to connect four cells together in order to operate one moderate size spinner, and still utilization the remaining cells separately connected to four smaller plant spinners.

Obviously there are numerous combinations that can be achieved depending upon the user's desires and the number of cells that are incorporated during manufacture of the petal solar cell device.

What is claimed is:

1. A plant spinner for plants cultivated by window light comprising:

an assembly housing for mounting on a stationary support;

an electric motor secured in said housing;

a reduction gear box secured to said motor for reduction of the speed thereof;

a swivel secured to an output shaft of the gear box and having means for connection to a potted plant to effect rotation thereof by the motor and operable to permit rotation of the potted plant relative to the output shaft for protection of said motor and said solar cell in the event of obstruction of free rotation of the potted plant; and, a solar cell device comprising a simulated plant with a plurality of solar cells thereon at least one of which is electrically connected to the motor for supplying power thereto; and, means for securing said simulated plant to a window pane for exposure of the solar cells to light from the sun.

2. A plant spinner as set forth in claim 1 wherein the simulated plant comprises a simulated flower head having a ring of individual, equally spaced, simulated petals, radially extending from a central portion, a separate solar cell being secured to each of said simulated petals, circuit means for electrically connecting said solar cells in either series or parallel arrangement to the electric motor and the securing means comprising means for securing said central portion of said flower head to the window pane with said ring of petals in equally spaced, radially extending, substantially coplanar relation adjacent to the window pane.

3. A plant spinner as set forth in claim 1, wherein said swivel includes a hook or eye that can movably receive a hook secured to said potted plant to depend said potted plant from said plant spinner.

4. A plant spinner as set forth in claim 3, wherein each said solar cell of said simulated flower is connected by a cable to another, similar, motor, similar gear box, and similar swivel, for depending another similar, potted plant therefrom and one said plant spinner is connectable in a series or parallel arrangement electrically, for supporting larger potted plants.

5. A plant spinner for plants cultivated by window light comprising:

an assembly housing for mounting on a stationary support;

an electric motor secured in said housing;

a reduction gear box secured to said motor for reduction of the speed thereof;

a solar cell device comprising a simulated flower head having a ring of individual, equally spaced, simulated petals, radially extending from a central portion, a plurality of solar cells, respective solar cells being secured to respective simulated petals, circuit means for electrically connecting said solar cells to the electric motor; and, means for securing said central portion of said flower head to a window pane with said ring of petals in equally spaced, radially extending, substantially coplanar relation adjacent the window pane.

6. A flower-form solar cell device for a plant spinner comprising a simulated flower decoration having a ring of individual, equally spaced, petals radially extending from a central portion of a simulated flower head, a separate solar cell secured to each of said petals, circuit means for electrically connecting said solar cells in either series or parallel arrangement to an external device, and means for securing said central portion of said flower head to a window pane with said ring of petals arranged in equally spaced radially extending, substantially coplanar relation adjacent the window pane.

7. A flower-form solar cell device as set forth in claim 6 wherein the securing means is an adhesive layer on said central portion.

* * * * *